US005580113A

United States Patent [19]

Pomerville et al.

[11] Patent Number: 5,580,113

[45] Date of Patent: Dec. 3, 1996

[54] REMOTE CONTROL CRANE/LOAD SAFETY SHACKLE

[75] Inventors: Thomas E. Pomerville; Ronald L. Williams, both of Midland; Joseph E. Kauffman, Hemlock, all of Mich.

[73] Assignee: Magnum Construction Company, Inc., Midland, Mich.

[21] Appl. No.: 463,914

[22] Filed: Jun. 5, 1995

[51] Int. Cl.[6] ..... B66C 1/34

[52] U.S. Cl. ..... 294/82.35; 294/82.3; 294/905

[58] Field of Search ..... 294/67.2–67.22, 294/75, 82.24–82.27, 82.3, 82.31, 82.35, 905; 24/600.4–600.8, 601.6

[56] References Cited

U.S. PATENT DOCUMENTS

| | | | |
|---|---|---|---|
| 3,154,337 | 10/1964 | Walker | 294/82.35 X |
| 3,895,836 | 7/1975 | Barnes | 294/82.35 |
| 4,216,987 | 8/1980 | Ely | 294/82.35 |
| 4,453,622 | 6/1984 | Betz | 294/82.35 X |

FOREIGN PATENT DOCUMENTS

| | | | |
|---|---|---|---|
| 2728528 | 1/1979 | Germany | 294/82.35 |
| 188392 | 7/1990 | Japan | 294/82.35 |
| 619438 | 8/1978 | U.S.S.R. | 294/82.35 |
| 1474070 | 4/1989 | U.S.S.R. | 294/82.35 |
| 3305 | of 1914 | United Kingdom | 294/82.35 |
| 903828 | 8/1962 | United Kingdom | 294/82.35 |

*Primary Examiner*—Johnny D. Cherry
*Attorney, Agent, or Firm*—Barnes, Kisselle, Raisch, Choate, Whittemore & Hulbert

[57] ABSTRACT

A crane/load safety shackle that includes a yoke having a slot that opens along one side edge of the yoke, and a buckle opening for securing the yoke to a crane load line such that the slot opens downwardly. A pin moveably slidably extends laterally across the slot for closing the slot and supporting a load carried by the shackle. A linear actuator and remote control electronics are mounted on the yoke and coupled to the pin for selectively extending the pin across the slot to support the load carried by the shackle, and retracting the pin from the slot so as to release the load. In the event that the load is supported by the pin and thus exerts lateral forces on the pin, the actuator has insufficient power to withdraw the pin from the slot against such lateral forces applied by the load, so that the load will not be inadvertently released.

4 Claims, 1 Drawing Sheet

REMOTE CONTROL CRANE/LOAD SAFETY SHACKLE

The present invention is directed to a device for coupling a load to the load line of an erection crane or the like and for safe release by a remote operator of the load carried by the load line.

BACKGROUND AND SUMMARY OF THE INVENTION

In the art of erecting steel beams and columns, there is a need for a device that will allow an operator to release the column or beam from the load line of an erection crane from a position remote from the beam. Such a device will help protect operators from injury when the beam or column is released. It is a general object of the present invention to provide such a device.

Simply stated, the present invention is directed to a crane/load safety shackle for supporting a load on the end of an erection crane load line, and for permitting release of a load from the load line by an operator positioned remotely of the load. An important feature of the crane/load safety shackle in accordance with the invention is that it will prevent release of the load in the event that the load is fully supported by the shackle, which is to say that the load is not fully supported by the ground or by construction. Thus, the safety shackle in accordance with the present invention will help prevent inadvertent release of a load.

The crane/load safety shackle in accordance with the present invention comprises a yoke having a slot that opens along one side edge of the yoke, and a buckle opening or other suitable means for securing the yoke to a crane load line such that the slot opens downwardly. A pin moveably slidably extends laterally across the slot for closing the slot and supporting a load carried by the shackle. A linear actuator and remote control electronics are mounted on the yoke and coupled to the pin for selectively extending the pin across the slot to support the load carried by the shackle, and retracting the pin from the slot so as to release the load. In the event that the load is supported by the pin and thus exerts lateral forces on the pin, the actuator has insufficient power to withdraw the pin from the slot against such lateral forces applied by the load, so that the load will not be inadvertently released.

The actuator in the preferred embodiment of the invention comprises a d.c. linear actuator, and the control electronics includes a rechargeable battery for suppling electrical power to the electronics and the actuator. Electrical power is selectively applied to the actuator by a remote control transmitter responsive to an operator and a receiver within the control electronics wirelessly coupled to the transmitter. The actuator and control electronics are carried within a protective enclosure mounted on one side of the yoke, and a counterbalance extends from the opposing side of the yoke for balancing the yoke with respect to the crane load line.

BRIEF DESCRIPTION OF THE DRAWING

The invention, together with additional objects, features and advantages thereof, will be best understood from the following description, the appended claims and the accompanying drawing in which:

DETAILED DESCRIPTION OF PREFERRED EMBODIMENT

Figure 1:
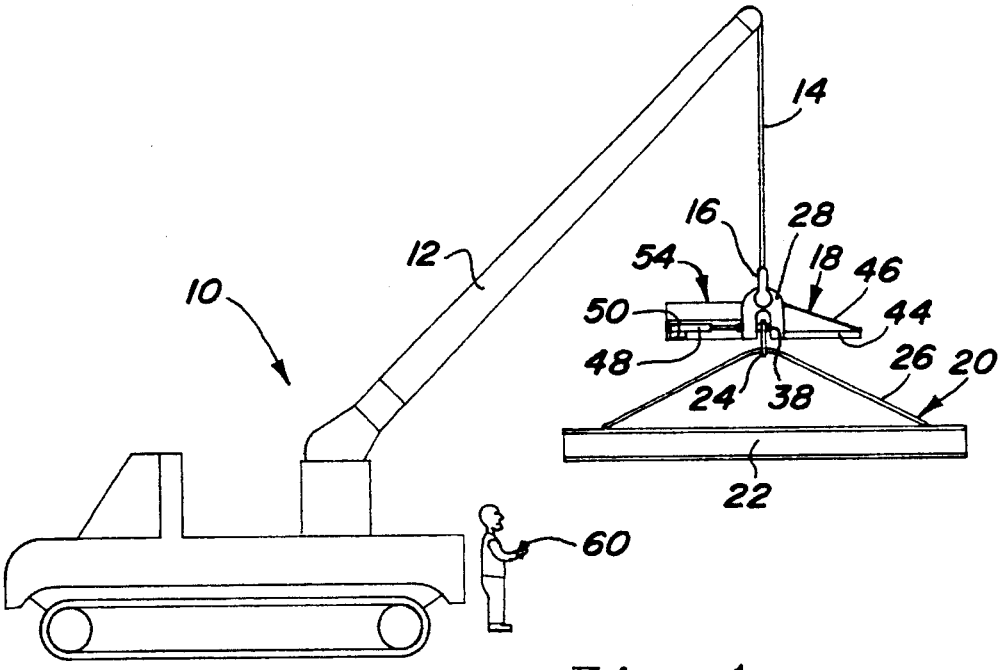
FIG. 1 is a schematic elevational view of an erection crane equipped with a crane/load safety shackle in accordance with the presently preferred embodiment of the invention.

FIG. 1 illustrates an erection crane 10 having a boom 12 from which a load line 14 depends. A crane/load safety shackle 18 in accordance with the present invention is pivotally connected to the end of load line 14 by a buckle 16. A load 20 is supported by shackle 18. Load 20 is illustrated in FIG. 1 as comprising a beam 22 suspended from shackle 18 by a harness that includes a link 24 and a cable 26. It will be appreciated, of course, that load 20 could as readily comprise a steel column or the like suspended from shackle 18 by a suitable choker or other harness.

Figure 2:
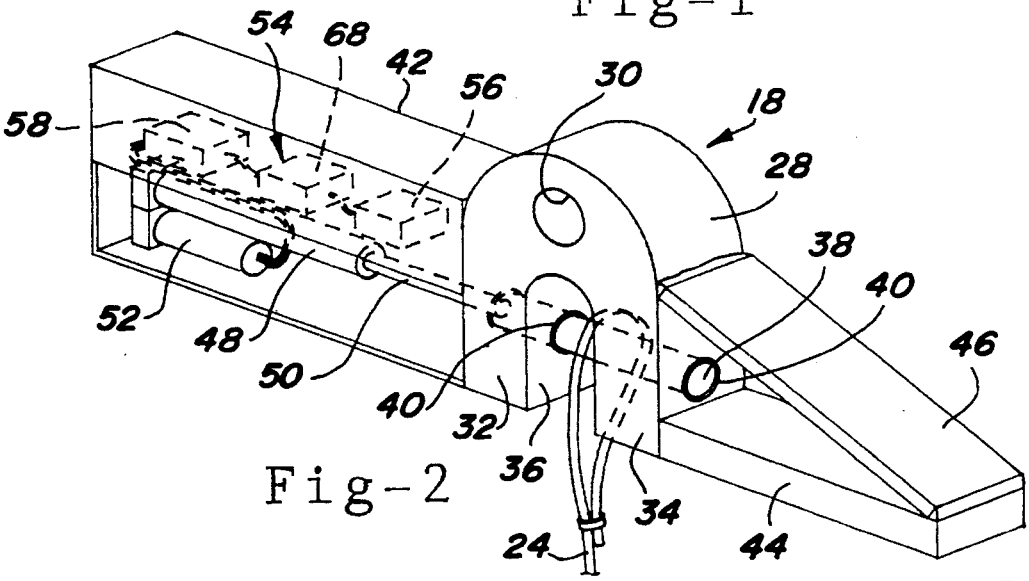
FIG. 2 is a perspective view of the crane/load safety shackle in accordance with the presently preferred embodiment of the invention.

Shackle 18 is illustrated in greater detail in FIG. 2 as comprising an inverted U-shaped yoke 28 having a through-opening 30 extending through the base or bight thereof for pivotal connection to buckle 16 (FIG. 1) at the end of load line 14. Yoke 28 has a pair of downwardly extending parallel arms that cooperate to define a downwardly opening slot 36 between the arms. A cylindrical pin 38 is slidably mounted by sleeve bearings 40 disposed in axially aligned openings that extend laterally through yoke arms 32, 34, pin 38 being thereby supported for sliding motion in the direction of its length laterally of slot 36. An enclosure 42 is cantilevered from arm 32 of yoke 28, and is counterbalanced by a pair of plates 44, 46 welded or otherwise externally secured to opposing yoke arm 34.

Figure 3:
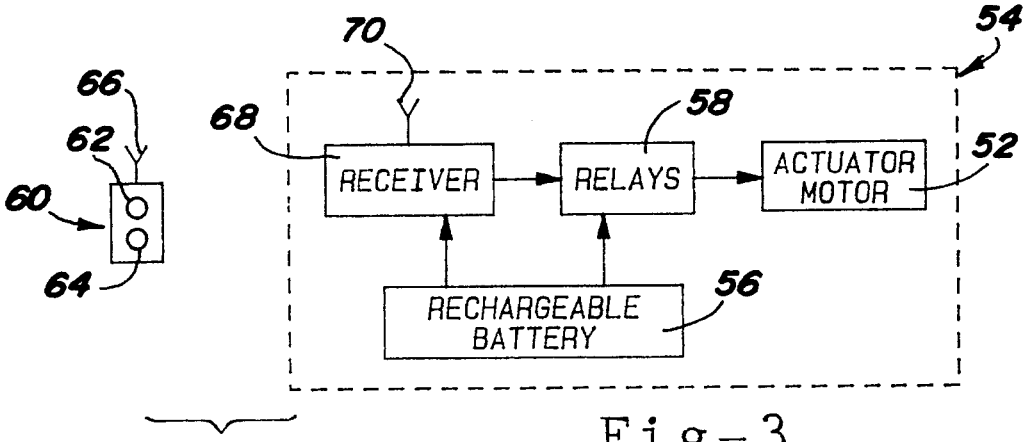
FIG. 3 is a functional block diagram of the safety shackle control electronics in the preferred embodiment of the invention.

Within enclosure 42, a linear actuator 48 has an actuator rod 50 that is coupled to pin 38 for sliding pin 38 in the direction of its length within bearings 40 into and out of yoke slot 36. Actuator 48 may be of any suitable type. In a presently preferred working embodiment of the invention, actuator 48 comprises a d.c. actuator marketed under the name Electrak by Warner Electric of South Beloit, Ill. This d.c. actuator has an actuator motor 52 connected to shaft 50 by a ball screw and suitable gears. The preferred actuator has a seventy-five pound load capacity. Also disposed within enclosure 42 is a control electronics package 54 (FIGS. 2 and 3) that includes a rechargeable battery 56 for supplying needed electrical power without external power connections. Battery 56 supplies electrical power to actuator motor 52 through suitable relays 58. An operator remote control 60 has buttons 62, 64 connected to internal electronics for applying an r.f. signal to an antenna 66 for selectively extending and retracting pin 38 of shackle 18. Control electronics 54 includes a corresponding r.f. receiver circuit 68 powered by battery 56 and coupled to a receiving antenna 70.

In operation, remote control 60 is first activated by an operator to signal control electronics 54 to activate actuator 48 so as to retract shaft 50 and thereby retract pin 38 from slot 36. With the slot thus open, link 24 or other suitable load connection means is manually positioned within slot 36. Remote control 60 is then activated so as to extend shaft 50 and pin 38 from actuator 48, so that pin 38 extends entirely laterally across slot 36 and is supported by spaced bearings 40 in yoke arms 32, 34. The power of actuator 48 is insufficient to retract shaft 50 and pin 38 from yoke slot 36 when a load is supported by pin 38. Forces applied by the load to the pin in the downward direction laterally of the axis of the pin create sufficient friction between the pin and bearings 40 to prevent retraction under load. However, it is also preferred for reasons of additional safety to place remote control 60 within a suitable container to prevent inadvertent attempted retraction of the pin when shackle 18 is supporting the load. When beam 22 has been positioned on the ground or other suitable support, or has been fixed in position between erection columns, load line 14 may be slackened so as to remove the load from pin 38, and pin 38 may then be retracted from yoke slot 36 by operator activation of remote control 60.

We claim:

1. A crane/load safety shackle that comprises:

a yoke having an open slot and means for securing said yoke to a crane load line such that said slot opens downwardly, a pin, means on said yoke mounting said pin for linear movement in the direction of its length laterally across said slot, and an electric actuator carried by said yoke and coupled to said pin for moving said pin between an extended position in which said pin extends entirely across said slot for support by said yoke on both sides of said slot and a retracted position in which said pin is fully retracted from said slot, electronic control means carried by said yoke and responsive to an operator for selectively actuating said actuator and thereby moving said pin between said extended and retracted positions, an enclosure cantilevered from said yoke on one lateral side of said slot, with said electronic control means and said actuator being disposed with said enclosure, and means cantilevered from said yoke on a lateral side thereof opposite said enclosure for counterbalancing weight of said enclosure, said electronic control means and said actuator.

2. The shackle set forth in claim 1 wherein said actuator comprises a d.c. actuator, and wherein said electronic control means further comprises a rechargable d.c. battery within said enclosure for supplying electrical power to said control means and said actuator, said counterbalancing means also counterbalancing weight of said rechargable battery within said enclosure.

3. The shackle set forth in claim 2 wherein said electronic control means includes a remote control operator transmitter and a receiver within said enclosure wirelessly coupled to said transmitter, said counterbalancing means also counterbalancing weight of said receiver within said enclosure.

4. The shackle set forth in claim 3 wherein said means mounting said pin comprises bearings carried by said yoke on opposed sides of said slot, said pin being supported in said extended position on both sides of said slot, said electric actuator being such that said pin cannot be moved laterally out of said slot when the load is supported by said pin.

* * * * *